United States Patent [19]

Näslund

[11] 4,380,573

[45] Apr. 19, 1983

[54] METHOD AND DEVICE FOR BENDING SECTION-SHEET, PLATE, STRIP AND LIKE MATERIAL

[75] Inventor: Gustav Näslund, Älvsbyn, Sweden

[73] Assignee: Korsträsk Mekaniska, G. Näslund, Älvsbyn, Sweden

[21] Appl. No.: 116,748

[22] Filed: Jan. 30, 1980

Related U.S. Application Data

[62] Division of Ser. No. 807,651, Jun. 17, 1977, Pat. No. 4,220,031.

[51] Int. Cl.[3] ..... B21D 13/00; B21D 13/10

[52] U.S. Cl. ..... 428/595; 52/630; 428/598; 428/603; 428/604; 72/379

[58] Field of Search ..... 52/630; 428/595, 598, 428/603, 604; 72/379

[56] References Cited

U.S. PATENT DOCUMENTS

| | | | |
|---|---|---|---|
| 3,011,289 | 12/1961 | Ochiltree | 52/630 |
| 3,310,925 | 3/1967 | Brun | 52/630 |
| 3,395,438 | 8/1968 | Seeff | 428/595 |
| 3,824,664 | 7/1974 | Seeff | 428/604 |

*Primary Examiner*—Brooks H. Hunt

*Attorney, Agent, or Firm*—Kenyon & Kenyon

[57] ABSTRACT

A corrugated sheet has a bend formed by one or more straight lines of impressions extending transversely across the corrugation valleys upwardly into the valleys and adjacent portions of the side walls between the valleys and the corrugation crests, and at the ends of the impressions the side walls have indents extending outwardly away from the impressions. The number of indents and impressions depends on the extent of the bend.

7 Claims, 6 Drawing Figures

METHOD AND DEVICE FOR BENDING SECTION-SHEET, PLATE, STRIP AND LIKE MATERIAL

This is a division of application Ser. No. 807,651, filed 6/17/77, now U.S. Pat. No. 4,220,031.

This invention relates to a method and a device for bending corrugated sheets, plates, strips and similar objects of metal or corresponding material, and particularly for bending corrugated sheets of trapezoid cross section perpendicularly to the longitudinal direction of the corrugations.

A corrugated sheet having corrugation ridge tops and valley bottoms formed by flat walls which are mutually parallel and positioned at different levels by flat side walls which angle downwardly from the ridge tops to the valley bottoms with the side wall of one valley bottom parallel to the corresponding side wall of the next valley, is the kind of corrugated sheet referred to above.

It is previously known to bend corrugated sheets perpendicularly to the longitudinal direction of the corrugations by rolling the sheets. It has proved very difficult, however, to roll-bend sheets with corrugations of relatively great depth and to obtain thereby a satisfactory shape of the bend proper and to prevent weakening of the material in the places where the bends are located.

The object of the present invention, therefore, is to provide a method of bending corrugated sheets perpendicularly to the longitudinal direction of the corrugations, by which method the aforesaid disadvantages are overcome or reduced substantially, and which renders it possible to bend even sheets with corrugations of relatively great depth to a desired angle. The invention further has the object of producing a simple and serviceable device for carrying out the method.

The invention is described in detail in the following, with reference to the accompanying drawings, in which.

Figure 4:
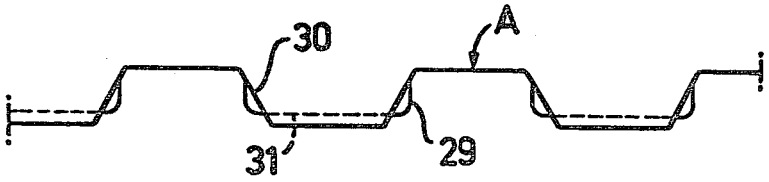
FIG. 4 is a section along the line IV—IV in FIG. 3, and FIGS. 5 and 6 are perspective views of a 90°-bend according to the invention.

The embodiment of the device according to the invention shown by way of example in the drawings is intended to be used particularly for bending trapezoid corrugated sheets, for example of the type shown in FIG. 4, perpendicularly to the longitudinal direction of the section corrugations. The device is designed so as to be capable to bend the sheet in two places simultaneously. The invention, of course, is not restricted to the type of corrugated sheets shown by way of example, but can be applied to the bending of many other types of corrugated sheets, plates, strips and so on.

The above embodiment of the device according to the invention comprises a table 1, which movably supports two carriages 2, which by means of a screw mechanism 4 with a hand wheel 3 for each carriage, can be set in different positions relative to each other and the table. Each carriage is provided with a press head 5, which is supported pivotally on a shaft 7 mounted in bearings 6 on the carriage 2 to be adjusted step-by-step to different angular positions in relation to the plane of the table from a substantially vertical position to a substantially horizontal position as indicated by dashed lines in FIG. 2. Said step-by-step adjustment of the press head 5 can be effected by a control device, for example in the form of a hydraulic cylinder 8, which is disposed between the carriage 2 and a locking disc 9 connected together with the shaft 7 or press head 5. Said locking disc 5 is provided with locking teeth 10 at least along a part of its periphery, which teeth cooperate with a pawl 12 controlled by a control device 11, for example in the form of a hydraulic cylinder, for locking the press head in different angular positions. The locking disc 9 of the embodiment shown is provided with six locking teeth 10, and the angle between two locking teeth is 15°. This implies the possibility of adjusting the press head to six different positions with an angular difference of each 15° therebetween. At other embodiments, of course, the locking disc may have a different number of teeth, and the angle between the teeth may be either greater or smaller, according to the number of adjusting positions desired for the press head 5.

Each press head comprises a sheet hold-down member 13 and beneath the same a press beam 14, both of which are vertically movable in the press head. The press beam is guided with its ends between guide means 16 located on the end walls 15 of the press head and is supported on two piston-cylinder arrangements 17 disposed in the press head, by means of which the press beam 14 can be lifted and lowered. The press beam 14, at its end facing toward the hold-down member 13, is provided with a press tool in the form of a thin press strip 18 having a rounded top edge extending along the greater part of the press beam length, or for an extent which at least corresponds to the width of the sheet to be bent.

The hold-down member 13, like the press beam 14, is guided at its ends between the guide means 16, and is suspended in the press head by two toggle levers 19, which are interconnected by a control device 20 shown in the form of a piston-cylinder arrangement, by which device the hold-down member 13 can be lifted and lowered to the extent permitted by said toggle levers 19. In order to prevent lateral movement of the hold-down member 13 in the press head 5, it is provided with a guide member 21, for example a guide wheel, disposed without horizontal looseness in a guide slot 22 of a plate 23 attached to the press head. In said guide slot also the control device 20 for the toggle levers 19 is fixed by means of a fixing member 24, preferably in the form of a wheel permitting movement of the control device 20 in vertical direction.

The hold-down member 13 comprises a beam 25, which at its end facing toward the press beam 14 is formed with a distance or spacer member 26, which is located directly in front of the press strip 18 and on each side exchangeably carries a sheet hold-down bar 27 with a longitudinal section corresponding to the cross section of the sheet to be bent, which hold-down bars 27 extend downwardly past the bottom surface of the spacer member 26 facing toward the press beam, through a distance corresponding substantially to the height of the press strip 18 on the press beam 14. The spacer member 26 holds the hold-down bars spaced apart so that between these bars a gap is formed having a width exceeding slightly the width of the press strip 18 plus twice the sheet thickness.

Figure 1:
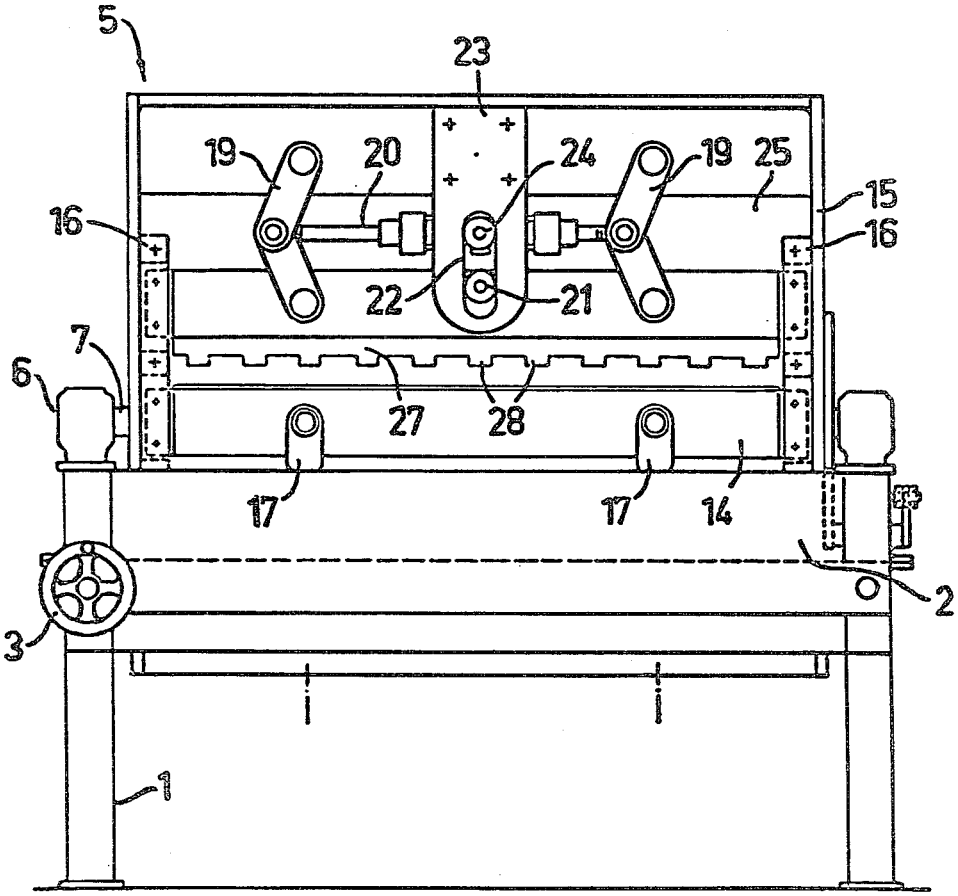
FIG. 1 is an end view of the bending device according to the invention.
Figure 2:
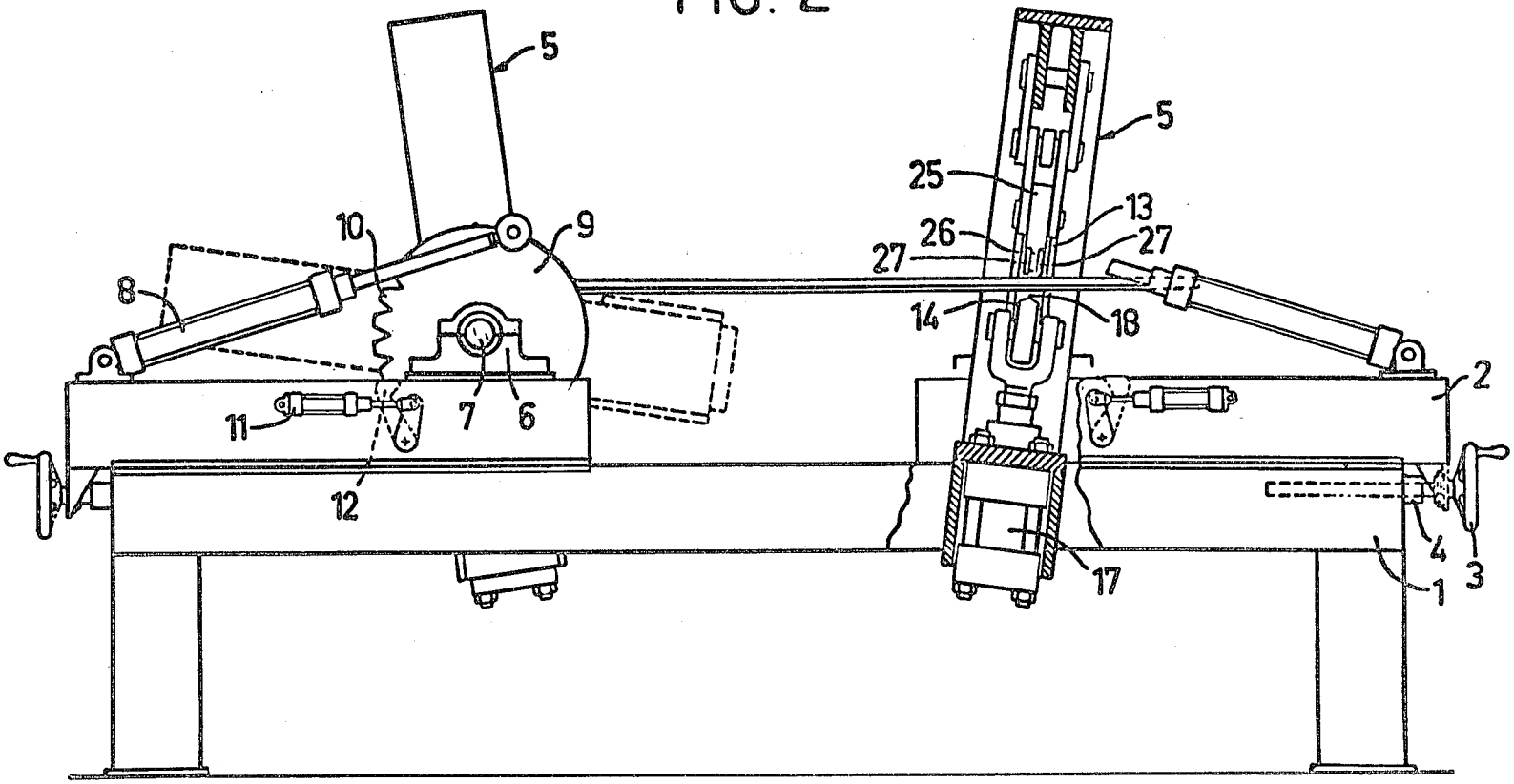
FIG. 2 is a lateral view of the same, partially in section, with a sheet inserted to be bent.
Figure 3:
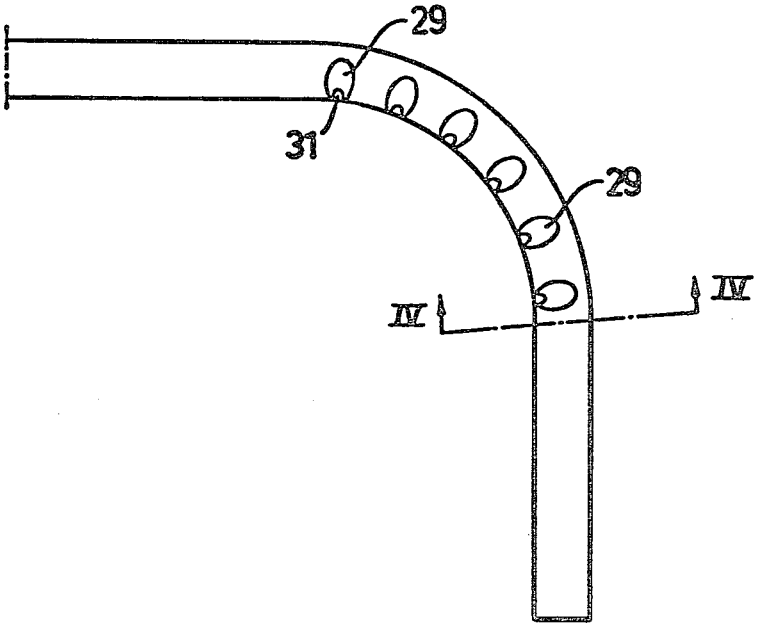
FIG. 3 is a schematic lateral view of a sheet bent in the bending device and after the method according to the invention.

When the press heads have been set in a vertical position or in the position shown in FIG. 2, a sheet to be bent can be introduced between the press beam 14 and the hold member 13 in the two press heads 5. If the press heads are not in the position shown in FIG. 2, they are set in this position by the control device 8 and locked therein by the pawl 12. In this position, the hold-down member 13 is lowered by the control device 20 and locked in this position by the toggle levers 19 being drawn into mutual alignment in each instance. The projections 28 of the hold-down bars 27 engage hereby with the so-called valleys in the section-sheet, which projections shall have a width corresponding to the width of the valleys at their bottom. When the hold-down member has been locked in its lowered position, the hydraulic cylinders 17 of the press beam are actuated for lifting the press beam 14 and thereby to force upwardly the press strip 18 extending across the bottoms of all of the corrugated sheet's valleys so as to bring about from below an impression 31 of the sheet between the two holding-up bars 27 over the entire width of each valley, whereby indentations 29 are formed in the upwardly facing lateral portions 30 of the valleys, as shown in FIGS. 3 and 4, without subjecting the sheet to detrimental stretching or drawing. In order to prevent drawing of the sheet especially in the case of two simultaneously operating press heads, at the beginning of the impressing each press head 5 can be disengaged from actuation by the pawl 12 and the control means 8, so that the head is "floating" in relation to the carriage and is held exclusively by the engagement of the press beam and hold-down member with the sheet. As soon as this engagement ceases after an impression was made, the press head again is locked in the position intended. By such an impression the sheet is bent one step, which at the embodiment shown corresponds to an angle of about 15°. Thereafter both the press beam 14 and the hold-down member 13 are returned to their respective end positions, and by release of the pawls 12 and via the cylinders 88 the two press heads 5 are stepped ahead a further step in opposed directions, which step at the embodiment shown corresponds to an angle of 15°. Thereafter the hold-down member 13 again is lowered and locked in this lowered position, and the press beam 14 is lifted in order by means of its press strip 18 to effect a new impression in the downwardly facing side of the valleys in the sheet, whereby the sheet is bent a further step corresponding to approximately 15°. This procedure is repeated until the sheet has been bent to the desired angle, which at the present embodiment is 90°, where the two press heads 5 assume the position indicated by dashed lines in FIG. 2, which implies that the bent sheet easily can be removed by being lifted straight upward when the hold-down member 13 and press beam 14 are opened.

Figure 5:
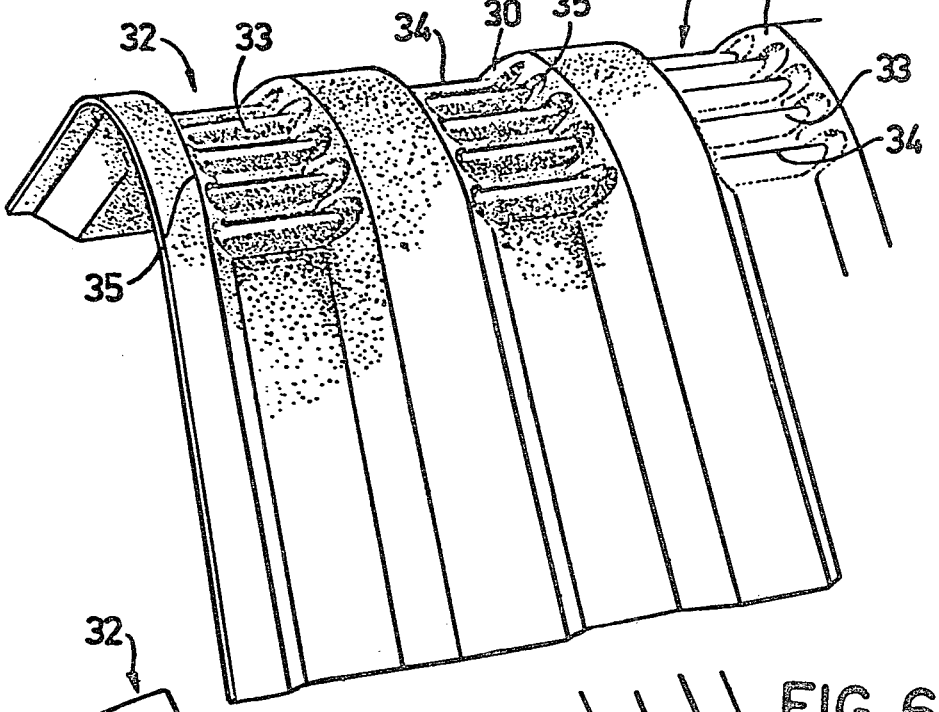
Figure 6:
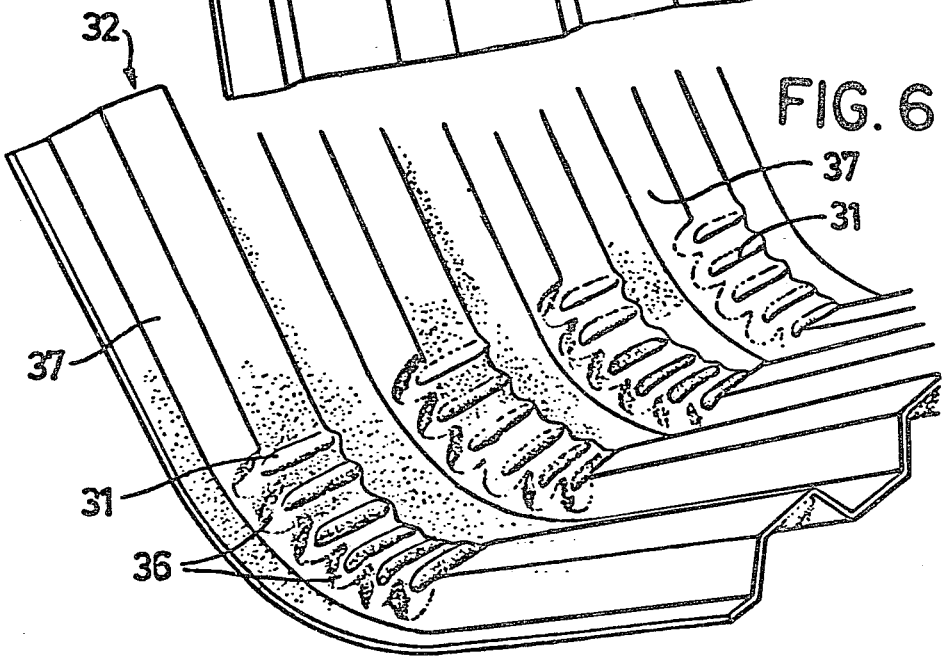

In FIGS. 5 and 6, a 90° bend obtained according to the invention in a corrugated sheet of trapezoid cross-section is shown from the upper and, respectively, lower surface of a sheet. Said bend includes on the lower surface of the sheet six impressions 31 of substantially arc-shaped cross-section in each of the valley-shaped portions 32 of the sheet, which impressions are corresponded by a number of elevations 33 at the upper side of said valley portions, as shown in FIG. 5. Each of said elevations has at its bottom a length corresponding to the width of the valley bottom and at its back portion 34 a length exceeding said lastmentioned width, and extends with its back portion into indentations 29 in the lateral portions 30 of the valley in question, which indentations are formed automatically when the impressions 31 are being made and extend taperingly up to the edge line 35. Said indentations 29 are corresponded by bulgings 36 on the other side of said lateral portions 30 designated by 37 in FIG. 6. The number of impressions 29 can be chosen to vary from one case to another and need not be six as at the embodiment shown.

The present invention is not restricted to the embodiment described above and shown in the drawings, but can be modified and altered in many different ways within the scope of the attached claims. The device according to the invention, for example, can be provided with only one press head, and its stepping can be effected in steps corresponding to an angle greater or smaller than the one mentioned above. It also is possible to abandon the pawl with associated details and instead to effect the necessary stepping of the press head or heads by cam-controlled electric valves (one cam for each desired position), which valves control the control device 8. The press tool and hold-down member may also exchange places, so that the press tool is positioned above what becomes the holding-up member in the press head.

What I claim is:

1. A method of bending a section-sheet comprising alternating longitudinal ridges and valleys, the side portions of which valleys also constitute side portions of the ridges, perpendicularly to the longitudinal directions of the ridges and valleys, characterized in that the lower surface of the valley bottoms is impressed from below on its entire width along a straight line in parallel with the valley bottoms, which line extends perpendicularly relative to said longitudinal direction, that the impression is made in radial direction relative to a shaft in parallel with and located on the same side of the sheet as said line between holding-up members positioned in relatively small spaced relationship, which members prior to the beginning of the impressing operation are tightened only to the upper surface of the valley bottoms to permit the sides of the lateral portions of the valleys forming a part of the lower surface of the sheet to bulge outward when the impression is being made, and after such an impression the relative position between the holding-up members and the sheet is changed for carrying out a second impression in parallel with the first one, whereafter this operation is repeated until the desired bending angle has been obtained.

2. A method according to claim 1, characterized in that for changing the relative position of the holding-up members and the sheet between two impressions, the holding-up members are turned about said shaft through a predetermined angle.

3. A method according to claim 2, characterized in that the predetermined angle is a multiple of the desired bending angle.

4. A sheet having a transverse contour comprising corrugations forming a series of mutually parallel ridges and valleys with common side walls, said sheet having a bend formed by at least one straight line of impressions extending transversely across said valleys upwardly into the valleys and adjacent portions of said side walls and at the ends of said impressions said side walls having indents extending outwardly away from the impressions.

5. The sheet of claim 4 in which said impressions are of substantially arc-shaped cross-section and said indents are concave.

6. The sheet of claim 4 in which said corrugations are of trapezoidal cross-section and said impressions have lengths greater than the widths of said valleys.

7. The sheet of claim 6 in which said impressions are formed by being forced upwardly into said valleys and side wall portions so as to bulge the side walls' said portions into the balance of the side wall and form said indents.

* * * * *